US005541471A

United States Patent [19]

Terheijden et al.

[11] Patent Number: 5,541,471

[45] Date of Patent: Jul. 30, 1996

[54] ELECTRIC LAMP

[75] Inventors: Joannes Terheijden; Josephus J. Timmermans, both of Eindhoven, Netherlands

[73] Assignee: U.S. Philips Corporation, New York, N.Y.

[21] Appl. No.: 353,839

[22] Filed: Dec. 12, 1994

[30] Foreign Application Priority Data

Dec. 14, 1993 [BE] Belgium ..... 09301383

[51] Int. Cl.[6] ..... H01J 61/30; H01J 61/38

[52] U.S. Cl. ..... 313/112; 313/636; 313/493; 501/53; 501/64; 501/69

[58] Field of Search ..... 313/112, 636, 313/634, 635, 110, 493; 501/53, 54, 55, 64, 69, 78

[56] References Cited

U.S. PATENT DOCUMENTS

| | | | |
|---|---|---|---|
| 3,531,677 | 9/1970 | Loughridge | 313/112 |
| 4,307,315 | 12/1981 | Meulemans et al. | 313/112 |
| 4,354,139 | 10/1982 | Konijnendijk et al. | 313/493 |
| 4,361,779 | 11/1982 | Van Der Steen et al. | 313/221 |
| 5,196,759 | 3/1993 | Parham et al. | 313/112 |

FOREIGN PATENT DOCUMENTS

| | | | |
|---|---|---|---|
| 0574158 | 12/1993 | European Pat. Off. | C03C 3/06 |
| 7714305 | 12/1977 | Netherlands | H01J 61/30 |

*Primary Examiner*—Nimeshkumar D. Patel
*Attorney, Agent, or Firm*—Brian J. Wieghaus

[57] ABSTRACT

An electric lamp has a light source which has an envelope of doped quartz glass. The quartz glass including silicon, cerium, titanium, europium and aluminium in oxidic form. Cerium accounts for 0.1–0.2, titanium for 0.01–0.04, europium for 0.03–0.2 and aluminium for at most 0.8 at % of the cationogenous elements. The aluminium/europium atomic ratio lies in the region from 3 to 8. The doped quartz glass is at least substantially transparent to visible radiation and at least substantially impervious to UV radiation.

12 Claims, 1 Drawing Sheet

ELECTRIC LAMP

BACKGROUND OF THE INVENTION

The invention relates to an electric lamp provided with a light source in a light-transmitting lamp vessel which is closed in a vacuumtight manner, which light source has an envelope of light-transmitting, UV-absorbing quartz glass which contains aluminium in oxidic form and a metal in oxidic form chosen from a group to which cerium and titanium belong.

A high-pressure discharge lamp of this kind is known from U.S. Pat. No. 3,531,677.

The known lamp has a quartz glass lamp vessel which has a layer of doped quartz glass at its outer surface. The doping in this case consists of a coloured, possibly UV-absorbing oxide or of cerium oxide or titanium oxide as a colourless, UV-absorbing substance. A disadvantage of the known lamp is that the lamp is impervious to only a portion of the UV spectrum and, dependent on the doping, also transmits only a portion of the light generated by the light source.

NL 77 14 305 discloses a high-pressure discharge lamp whose quartz glass lamp vessel consists of UV-absorbing doped quartz glass in chosen locations, for example, quartz glass with 0.02 mole % of each of the element europium, cerium, and titanium. The doped quartz glass here is present only in those locations of the lamp vessel where the latter, depending on the position which it occupies during operation, would have a comparatively low temperature without a dopant. Owing to the doping, UV is absorbed and the temperature in situ increases, which benefits the luminous efficacy of the lamp. The doped quartz glass, however, has a yellow colour so that it does not transmit all the generated light. Moreover, it does not absorb all UV radiation.

U.S. Pat. No. 4,361,779 discloses an electric lamp, a halogen incandescent lamp and a high-pressure discharge lamp, whose quartz glass lamp vessel has a doping of alkali oxide, alkaline earth oxide, rare earth oxide such as praseodymium oxide, possibly with aluminium oxide or europium oxide. The lamp vessel is strongly yellow-coloured and as a result is suitable for use in lamps, for example halogen lamps, which are to emit yellow light. The glass is closed to only a portion of the UV spectrum.

An electric incandescent lamp and a high-pressure discharge lamp with a doped quartz glass lamp vessel or with an outer envelope of such a glass are known from U.S. Pat. No. 5,196,759. The doping here consists of titanium oxide and cerium oxide and has the object of absorbing a portion of the UV radiation. Among the wavelengths which are not absorbed, however, is comparatively long-wave UV radiation.

A UV absorbing quartz glass and electric lamps having an envelope of that quartz glass are described in the European patent application of older date EP-A 0 574 158. The quartz glass contains at least 96% by weight of $SiO_2$ and europium oxide, titanium oxide and cerium oxide.

From this patent application it is apparent (FIG. 1) that the addition of europium oxide diminishes the UV-transmission of quartz glass doped with cerium oxide and titanium oxide, but also its transmission in the visible range of the spectrum, because it colours the glass yellow.

SUMMARY OF THE INVENTION

It is an object of the invention to provide an electric lamp of the kind mentioned in the opening paragraph which has an envelope which is at least substantially transparent to visible radiation and which is at least substantially impervious to UV radiation.

According to the invention, this object is achieved in that the quartz glass of the envelope comprises silicon, cerium, titanium, europium, and aluminium in oxidic form, cerium accounting for 0.1–0.2 at %, titanium for 0.01–0.04 at %, europium for 0.03–0.2 at %, and aluminium for a maximum of 0.8 at % of the cationogenous elements, while the atomic ratio aluminium/europium lies in the region 3–8.

It was found that quartz glass in which said elements are present in oxidic form and in the given quantities and ratios in the silicon dioxide matrix is at least substantially transparent to visible radiation and at least substantially impervious to UV radiation. The quartz glass, which will also be referred to as doped quartz glass hereinafter, owes these properties to all its components in their stated quantities in conjunction. The elements cerium, titanium, and europium each absorb a spectral portion of the UV radiation, which portions supplement one another and partly overlap one another. The oxidic aluminium keeps the europium in substantially its bivalent form dissolved in the matrix. Especially at an atomic ratio Al/Eu of 4 or higher, the UV absorption by europium is high as a result, as is the transmission of light. A favourable influence of aluminium is furthermore that it counteracts the rheological changes of the quartz glass caused by the presence of the bivalent europium. It was found on the other hand that a maximum value for the aluminium content is important because the doped quartz glass starts showing a tendency to crystallize at aluminium quantities above 0.8 at %. It was found to be favourable if there are at least four, in particular four aluminium atoms available for each europium atom in the doped quartz glass. On the other hand, it is favourable for a high $SiO_2$ content of the glass if the Al/Eu atomic ratio does not exceed the value of seven.

Also if europium is present in the trivalent oxidic form in the batch from which the quartz glass is obtained, the bivalent form will arise during melting in a reducing atmosphere, for example, of helium and hydrogen. The batch may comprise the oxides of the cationogenous elements of the doped quartz glass or alternatively mixed oxides of such elements.

In general, the quartz glass envelope of the light source will have a thickness of at least approximately 1 mm. The minimum quantities of the additives for the glass are based on this. Smaller quantities would render the glass insufficiently impervious to UV radiation. Given the maximum quantities of additives, the doped quartz glass will still comprise approximately 97% by weight silicon dioxide and will still have the properties of molten silicon dioxide to a high degree, apart from the optical properties. The doped quartz glass may contain impurities introduced by its components.

In a favourable embodiment, the doped quartz glass comprises 0.15 at % cerium, 0.02 at % titanium, 0.05 at % europium or quantities of these elements which may be up to 0.1 part greater or smaller per element. The atomic ratio aluminium/europium then lies in the region 4–7, and in particular is approximately 4.

The light source may be an incandescent body, for example made of tungsten, for example arranged in an inert gas comprising halogen. Alternatively, the light source may be a pair of electrodes in an ionizable medium, between which electrodes a, for example high-pressure, discharge arc is maintained during operation. The ionizable medium may comprise a rare gas, possibly with mercury, possibly with metal halide.

The lamp vessel and the envelope of doped quartz glass may be integral, in which case the lamp vessel, for example, consists entirely of the doped quartz glass. Alternatively, the envelope may be a separate body, for example, a body surrounding the lamp vessel. The envelope may then be an outer bulb which is closed in a vacuumtight manner, but alternatively it may be a body between the lamp vessel and an outer bulb, for example a tubular body which may or may not be closed at one end or both ends.

The envelope is important in all those cases in which the light source generates not only visible radiation but also UV radiation, and the lamp is to be used on account of the visible radiation generated. It is then prevented that the UV radiation causes injury or damage to living beings or goods. The envelope may also be important for bringing the light source to a higher temperature than it would have in the absence of the envelope. This generally benefits the luminous efficacy of the lamp. The envelope in the form of a tube in an outer bulb or of an outer bulb may also contribute to the safety of the lamp if there is a risk of the lamp vessel exploding and fragments thereof causing damage to the surroundings of the lamp in the absence of the envelope.

BRIEF DESCRIPTION OF DRAWINGS

Embodiments of the electric lamp according to the invention are shown in the drawing, in which.

DESCRIPTION OF THE PREFERRED EMBODIMENTS

Figure 1:
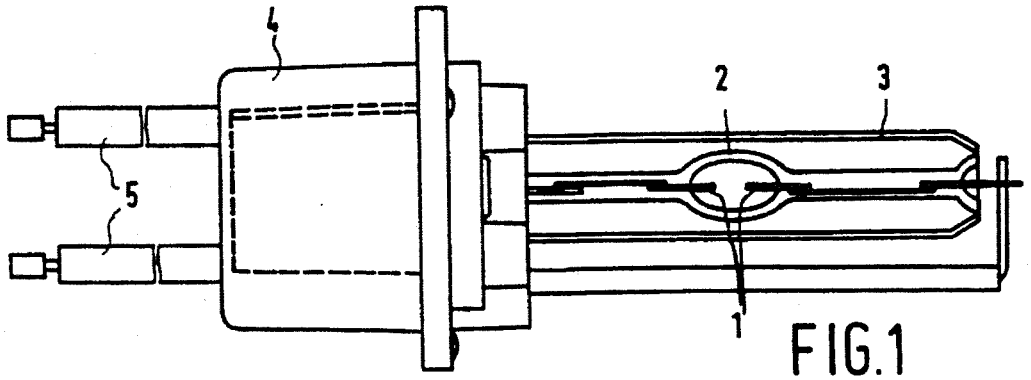
FIG. 1 shows a first embodiment in side elevation.

In FIG. 1, the electric lamp is provided with a light source 1 in a transparent quartz glass lamp vessel 2 which is closed in a vacuumtight manner. The light source in this Figure is a pair of electrodes in an ionizable gas, for example, rare gas, mercury and metal halides. The light source has an envelope 3 of light-transmitting, UV-absorbing quartz glass which contains aluminium in oxidic form and a metal chosen from a group to which cerium and titanium belong, in oxidic form. The envelope of doped quartz glass is fused to the lamp vessel at the ends of the latter. The lamp has a lamp cap 4 from which cables 5 issue to the exterior for connection to a supply source. The lamp may be used as a motorcar headlamp.

The quartz glass of the envelope 3 comprises silicon, cerium, titanium, europium, and aluminium in oxidic form, cerium accounting for 0.1–0.2 at %, titanium for 0.01–0.04 at %, europium for 0.03–0.2 at %, and aluminium for at most 0.8 at % of the cationogenous elements, while the atomic ratio aluminium/europium lies in the region 3–8.

The quartz glass of the envelope 3 may contain, for example, 0.15 at % cerium, 0.02 at % titanium, 0.05 at % europium, or quantifies of these elements which are up to 0.1 part greater or smaller for each element. The atomic ratio aluminium/europium may lie in the region 4–7, and in particular may be 4.

The lamp drawn has an envelope of doped quartz glass obtained from a batch having the composition of Ex 1 from Table 1.

Figure 2:
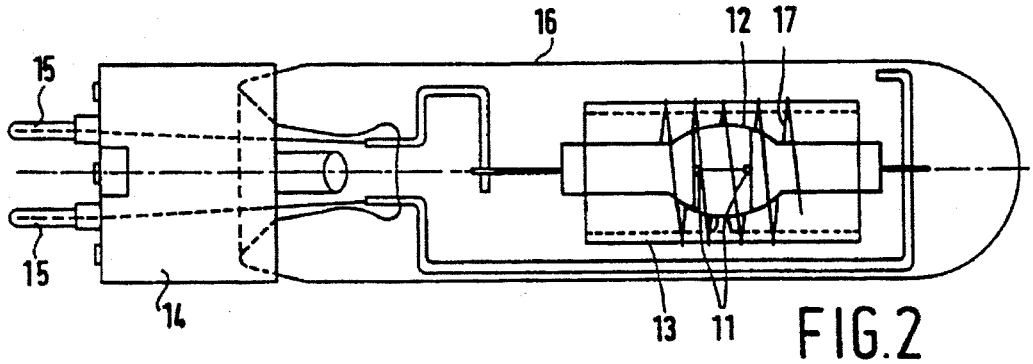
FIG. 2 shows a second embodiment in side elevation.

In FIG. 2, corresponding parts have reference numerals which are ten higher than those in FIG. 1. The discharge lamp for general lighting purposes as shown has a tubular envelope of doped quartz glass 13 inside an outer bulb 16 which is closed in a vacuumtight manner. Said envelope is surrounded by a helically coiled metal wire 17 and absorbs the UV radiation generated by the light source, while transmitting the visible radiation. Together with the metal wire, the envelope prevents damage to the outer bulb 16 if the lamp vessel should explode. The lamp cap 14 has contact pins 15.

Figure 3:
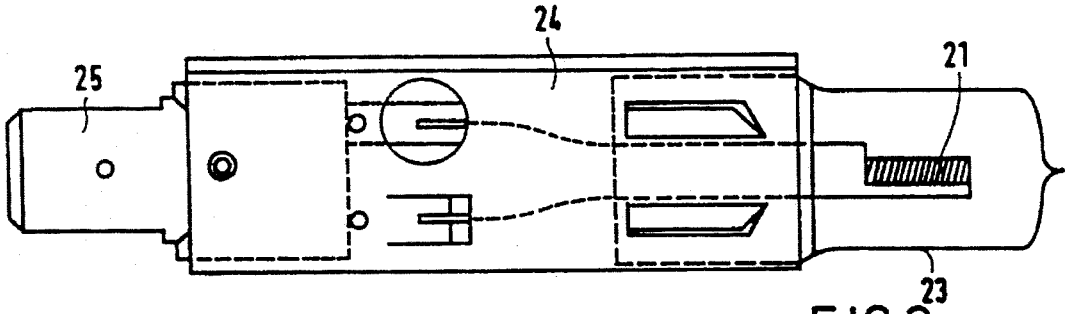
FIG. 3 shows a third embodiment in side elevation.

In FIG. 3, the lamp has an incandescent body as the light source. The envelope 23 of doped quartz glass is closed in a vacuumtight manner. It has thus been integrated with the lamp vessel. It may be filled with a gas comprising halogen. The metal lamp cap 24 has the shape of a tube which supports an insulated contact 25 and which itself serves as a second contact. The lamp is suitable for acting as a UV-free motorcar lamp.

Examples of the batches giving the doped quartz glass which may be used in the electric lamp according to the invention have been given in Table 1 in atomic percents, Ex 1 also in percents by weight.

TABLE 1

| Ex | 1) gew % | 1) at % M | 2) at % M | 3) at % M | 4) at % M | 5) at % M | 6) at % M | 7) at % M | 8) at % M | 9) at % M |
|---|---|---|---|---|---|---|---|---|---|---|
| $CeAlO_3$ | 0.54 | 0.15* | | 0.15* | | | 0.1* | | | |
| $TiO_2$ | 0.03 | 0.02 | 0.02 | 0.03 | 0.03 | 0*03 | 0.03 | 0.04 | 0.03 | 0.03 |
| $Eu_2O_3$ | 0.09 | 0.05 | 0.05 | 0.05 | 0.03 | 0.05 | 0.05 | 0.05 | 0.1 | 0.2 |
| $Al_2O_3$ | 0.33 | 0.2** | 0.35 | 0.2** | 0.24 | 0.25 | 0.2** | 0.2 | 0.3 | 0.8 |
| $Ce_2Si_2O_7$ | | | 0.2̂ | | 0.1̂5 | 0.1̂5 | | 0.1̂5 | 0.1̂5 | 0.15 |
| $SiO_2$ | 99.01 | 99.43 | 99.1̂8̂ | 99.42 | 99.4̂ | 99.3̂7̂ | 99.52 | 99.4̂2̂ | 99.2̂7̂ | 98.6̂7̂ |
| at Al/at Eu | | 7 | 7 | 7 | 8 | 5 | 6 | 4 | 3 | 4 |

M cationogenous element
*value of Ce and Al together
**exclusive of Al in $CeAlO_3$
̂ value of Ce and Si together
̂̂ exclusive of Si in $Ce_2Si_2O_7$.

Figure 4:
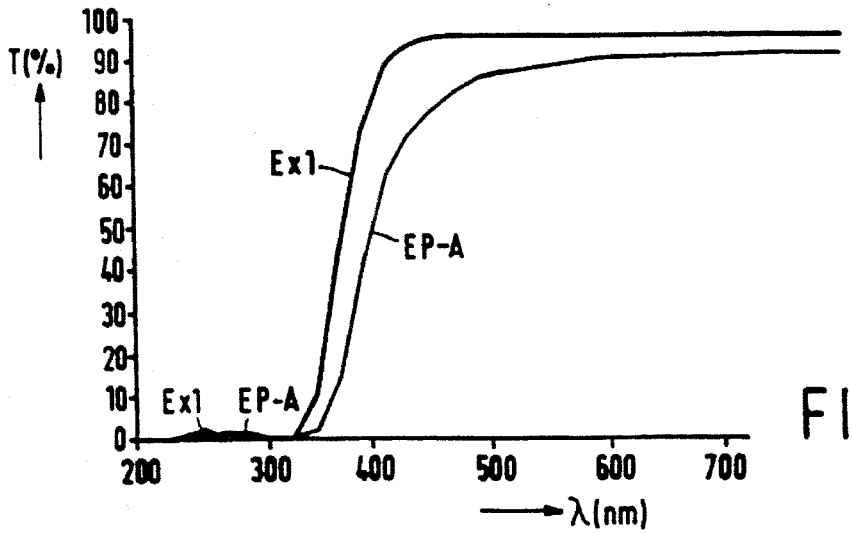
FIG. 4 shows the transmission curve of example 1 and such curve of the glass described in EP-A 0 574 158.

FIG. 4 shows the transmission curve of the quartz glass obtained from the batch of Ex 1 from the Table and such curve of the glass described in EP-A 0 574 158. The curve shows that the glass is at least substantially transparent to visible radiation and at least substantially impervious to UV radiation. It is noted that indeed the transmission in the visible portion of the spectrum is only approximately 92%, but the loss is constant and not due to absorption but to reflection which always takes place at surfaces owing to the difference in refractive index, in the case drawn between glass and air.

From FIG. 4 it is apparent that the glass described in EP-A 0 574 158 has a substantial lower transmission in the visible range of the spectrum.

The compositions of the two glasses are represented in a comparable manner in Table 2, expressed as weight parts per million of the doping cations.

TABLE 2

| | Eu | Ti | Ce | Al |
|---|---|---|---|---|
| Ex 1 | 1270 | 160 | 3500 | 1570 |
| EPA-A | 500 | 500 | 4000 | |

We claim:

1. An electric lamp, comprising:

a light source having a light-transmitting lamp vessel closed in a vacuum-tight manner, and an outer envelope of light-transmitting, UV-absorbing quartz glass enclosing said light source, said quartz glass of the envelope comprising silicon, cerium, titanium, europium, and aluminium in oxidic form, cerium accounting for 0.1–0.2 at %, titanium for 0.01–0.04 at %, europium for 0.03–0.2 at % and aluminium for a maximum of 0.8 at % of the cationogenous elements, while the atomic ratio of aluminium to europium lies in the region of 3 to 8.

2. An electric lamp as claimed in claim 1, characterized in that the quartz glass of the envelope comprises 0.15±0.015 at % cerium, 0.02±0.002 at % titanium, and 0.05±0.005 at % europium.

3. An electric lamp as claimed in claim 2, characterized in that the atomic ratio of aluminum to europium lies in the region of 4 to 7.

4. An electric lamp as claimed in claim 2, characterized in that the atomic ratio of aluminium to europium is 4.

5. An electric lamp as claimed in claim 1, characterized in that the atomic ratio of aluminium to europium lies in the region of 4 to 7.

6. An electric lamp as claimed in claim 1, characterized in that the atomic ratio of aluminium to europium is 4.

7. An electric lamp, comprising:

a light source energizable for emitting light, said light source comprising a light-transmitting, UV absorbing quartz glass lamp vessel closed in a vacuum-tight manner, said quartz glass comprising silicon, cerium, titanium, europium, and aluminium in oxidic form, cerium accounting for 0.1–0.2 at %, and titanium for 0.01–0.04 at % of the cationogenous elements, while the atomic ratio of aluminium to europium lies in the region of 3 to 8.

8. An electric lamp as claimed in claim 7, characterized in that the quartz glass of the envelope comprises 0.15±0.015 at % cerium, 0.02±0.002 at % titanium, and 0.05±0.005 at % europium.

9. An electric lamp as claimed in claim 8, characterized in that the atomic ratio of aluminium to europium lies in the region of 4 to 7.

10. An electric lamp as claimed in claim 8, characterized in that the atomic ratio of aluminium to europium is 4.

11. An electric lamp as claimed in claim 7, characterized in that the atomic ratio of aluminium to europium lies in the region of 4 to 7.

12. An electric lamp as claimed in claim 7, characterized in that the atomic ratio of aluminium to europium is 4.

* * * * *